United States Patent [19]

Cagey

[11] Patent Number: 4,709,913

[45] Date of Patent: Dec. 1, 1987

[54] STORAGE CASSETTE FOR FILM PROCESSING SYSTEM

[75] Inventor: Lee B. Cagey, Fairfax, Va.

[73] Assignee: LogEtronics, Inc., Springfield, Va.

[21] Appl. No.: 927,030

[22] Filed: Nov. 5, 1986

[51] Int. Cl.[4] ..... B65H 31/00

[52] U.S. Cl. ..... 271/207; 271/279; 53/266 R; 206/455; 354/277; 354/281

[58] Field of Search ..... 271/279, 207, 220, 145, 271/162; 53/266 R; 206/449, 455; 354/276, 277, 281

[56] References Cited

U.S. PATENT DOCUMENTS

| | | |
|---|---|---|
| 355,056 | 12/1886 | Bowdish . |
| 628,889 | 7/1899 | Lewis . |
| 1,267,159 | 5/1918 | Zuckerman . |
| 1,497,260 | 6/1924 | Edtl . |
| 1,631,479 | 6/1927 | Folmer . |
| 2,114,638 | 4/1938 | Parker . |
| 2,329,228 | 9/1943 | Stiffler . |
| 4,008,483 | 2/1977 | Swift . |
| 4,135,802 | 1/1979 | Scharre . |
| 4,195,923 | 4/1980 | Craven . |
| 4,393,642 | 7/1983 | Plessers ..... 271/207 |

*Primary Examiner*—Richard A. Schacher

*Attorney, Agent, or Firm*—Pollock, Vande Sande & Priddy

[57] ABSTRACT

A film sheet storage cassette. A channel mounting bracket supports a rectangular enclosure in position to receive cut film sheets. The enclosure includes a top flange which is slidable into the channel and held in position to receive through an entrance slot the paper film sheets. A spring biased door is supported for movement in the plane of the flange to cover and uncover said slot. The channel includes camming slots which receive upstanding camming tabs. Insertion of the cassette flange into said channel forces said camming tabs along said camming slots moving the door to its open position.

4 Claims, 12 Drawing Figures

18
19
20
21
23
24
26
27
27c
27d
28a
28b
33
33a
33b
34
34a
34b
35
37
38
39
40
44

FIG. 7
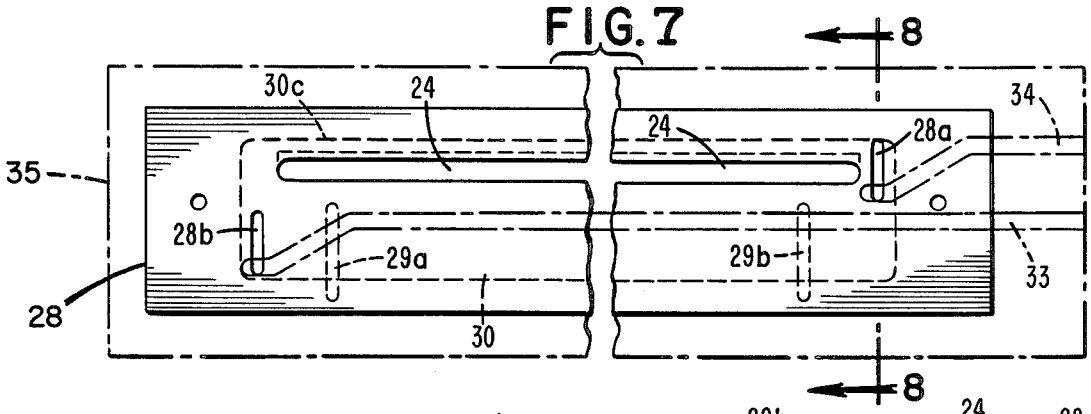
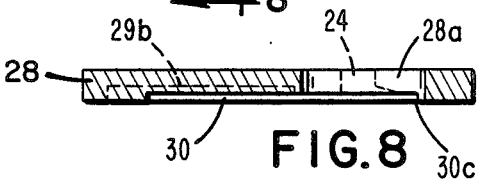
FIG. 8
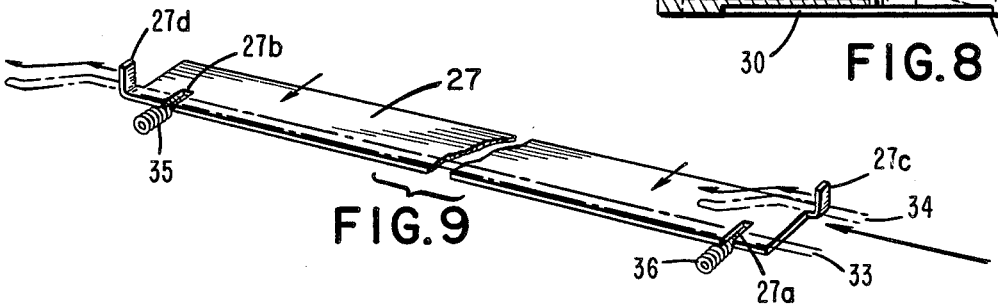
FIG. 9
FIG. 10
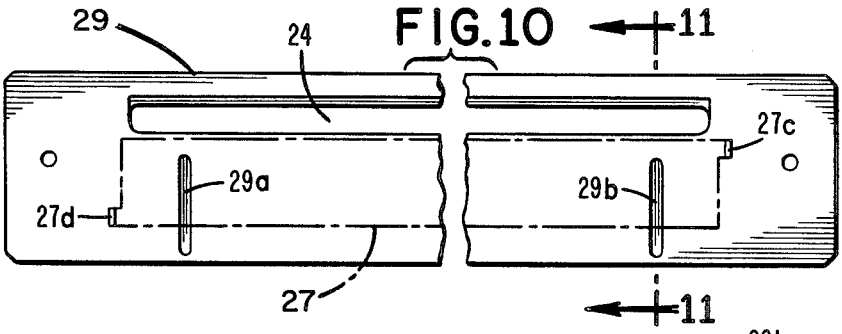
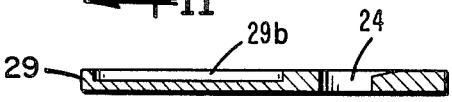
FIG. 11
FIG. 12
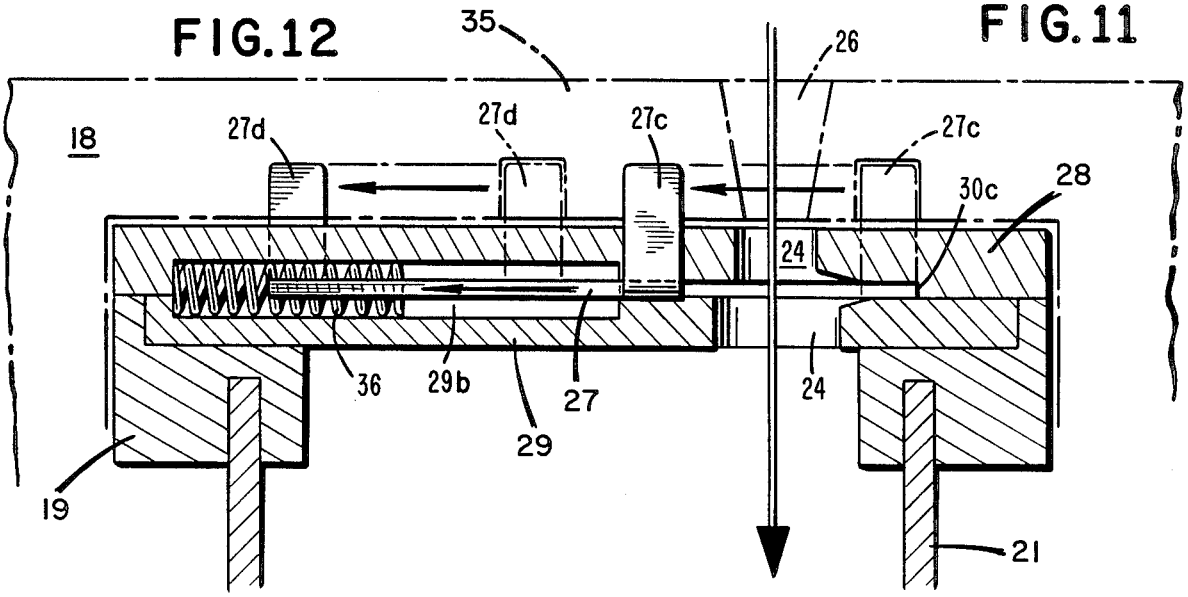

STORAGE CASSETTE FOR FILM PROCESSING SYSTEM

The present invention relates to film storage cassettes for receiving and storing exposed photographic film sheets. Specifically, a light-tight storage cassette is described, having an entrance door which operates upon insertion and removal of the storage cassette device from its operating position.

Storage cassette devices for receiving exposed film and providing for a light-tight environment are known in the art. These storage cassette devices typically provide an entrance door which is operated by an approaching film sheet. The door is forced open by the approaching film sheet, and the photographic film sheet is received in the storage device. Typically, the door will be forced into the cassette storage device which will decrease the amount of available room for storage of the film sheets. Additionally, these devices have been known to rub against entering film sheets, such as to scratch and destroy the surface of the arriving film sheet.

The present invention is provided to avoid the aforementioned difficulties with a cassette having a door opened by an arriving film sheet. The present invention is provided with a cam-operated entrance door, which is retracted laterally, avoiding reduction in the amount of storage space available for arriving film sheets. Additionally, no contact with an arriving film sheet is necessary with the slidable door.

Upon removal of the cassette, the slidable door assumes its closed position, maintaining the storage cassette sealed from an inadvertent exposure.

SUMMARY OF THE INVENTION

An object of the invention is to provide a light tight removable storage cassette for storing exposed photographic film sheets.

It is a further object of this invention to provide a storage cassette which opens and closes upon insertion and removal of the cassette from its film receiving position.

These and other objects of the invention are provided by a storage cassette device in accordance with the invention. The cassette device is a removable storage container equipped at one end with a flange for engaging a channel on a film processing system. The flange includes a slot for receiving sheets of light sensitive material, and a retractable door to seal the slot against light when removing the cassette device from the channel. Camming slots in the channel engage a pair of cam tabs on the door to slide the door against a bias means to open the door during insertion. During removal, the bias means closes the door, making the cassette device light-tight.

In a preferred embodiment of the invention, the cassette device flange comprises an upper and lower plate including a recess which retains the movable door for movement in the plane of the flange slot. The door is biased against one end of the recesses, closing off the longitudinal material receiving slot by two springs in the recess. A pair of vertical upstanding tabs are located on opposite diagonal corners of the door. First and second lateral slots in the top plate permit the tabs to move in a direction for moving the door in the recess against the biasing springs, uncovering the longitudinal film or paper receiving slot.

The channel on the film processing system includes a receiving slot for exposed film or paper which is aligned with the cassette device material receiving slot. A separate camming surface is provided for alignment with each tab of the door. Upon insertion of the cassette device flange in the channel, the camming surfaces will force the tabs in a direction to open the door.

BRIEF DESCRIPTION OF THE FIGURES

FIG. 7 is a top view of the top plate 28 of the rectangular flange of the cassette box 21.

FIG. 8 is a side-section view of the top plate 28 of rectangular flange 19.

FIG. 9 is a profile of the movable door 27 for sealing the cassette storage device.

FIG. 10 is a top view of the bottom plate 29 of the flange 19.

FIG. 11 is a side-section view of bottom plate 29 of the flange 19.

FIG. 12 is a section view of the assembled top plate 28, bottom plate 29 and slidable door 27.

DESCRIPTION OF THE PREFERRED EMBODIMENT

Figure 1:
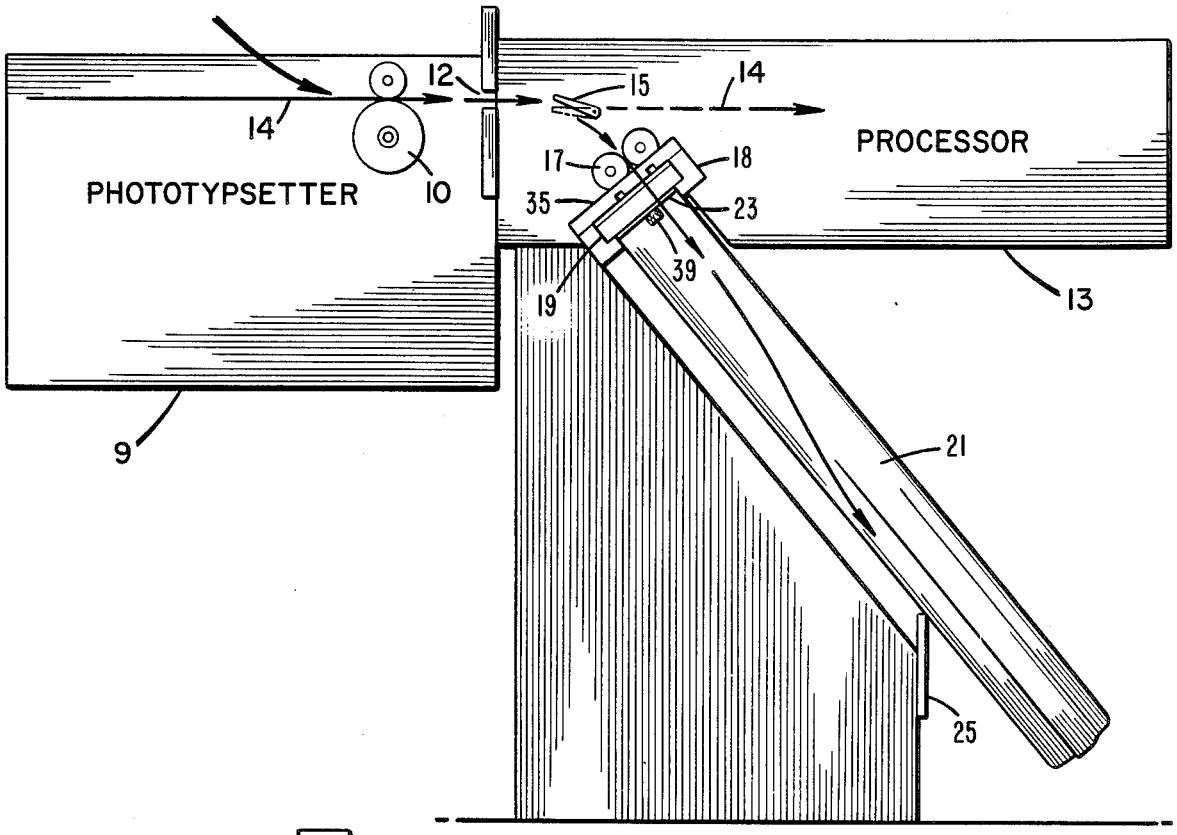
FIG. 1 illustrates a phototypessetter and film processor which employs a cassette storage device in accordance with the invention.

Referring now to FIG. 1, there is shown the cassette device in accordance with one embodiment of the invention inserted in a photographic processing system. In the system of FIG. 1, exposed photographic sheets from a phototypesetter 9 are conveyed over a processing path 14 through an exit aperture 12 to a photographic processor 13. Exit rollers 10 for the phototypsetter convey cut sheets of exposed photographic film through the exit aperture 12.

Processor 13 may at times be incapable of receiving and processing further photographic sheets. At such time, a solenoid is operated to divert the fed sheets into a storage cassette. A path diverter 15 is shown in FIG. 1 which, when operated by an associated solenoid, conveys the cut exposed film sheets into the nip of a pair of rollers 17. Rollers 17 will convey the processed sheets through a slot into the cassette device 21. Sheets of exposed photographic film will be collected in the cassette device 21.

Figure 2:
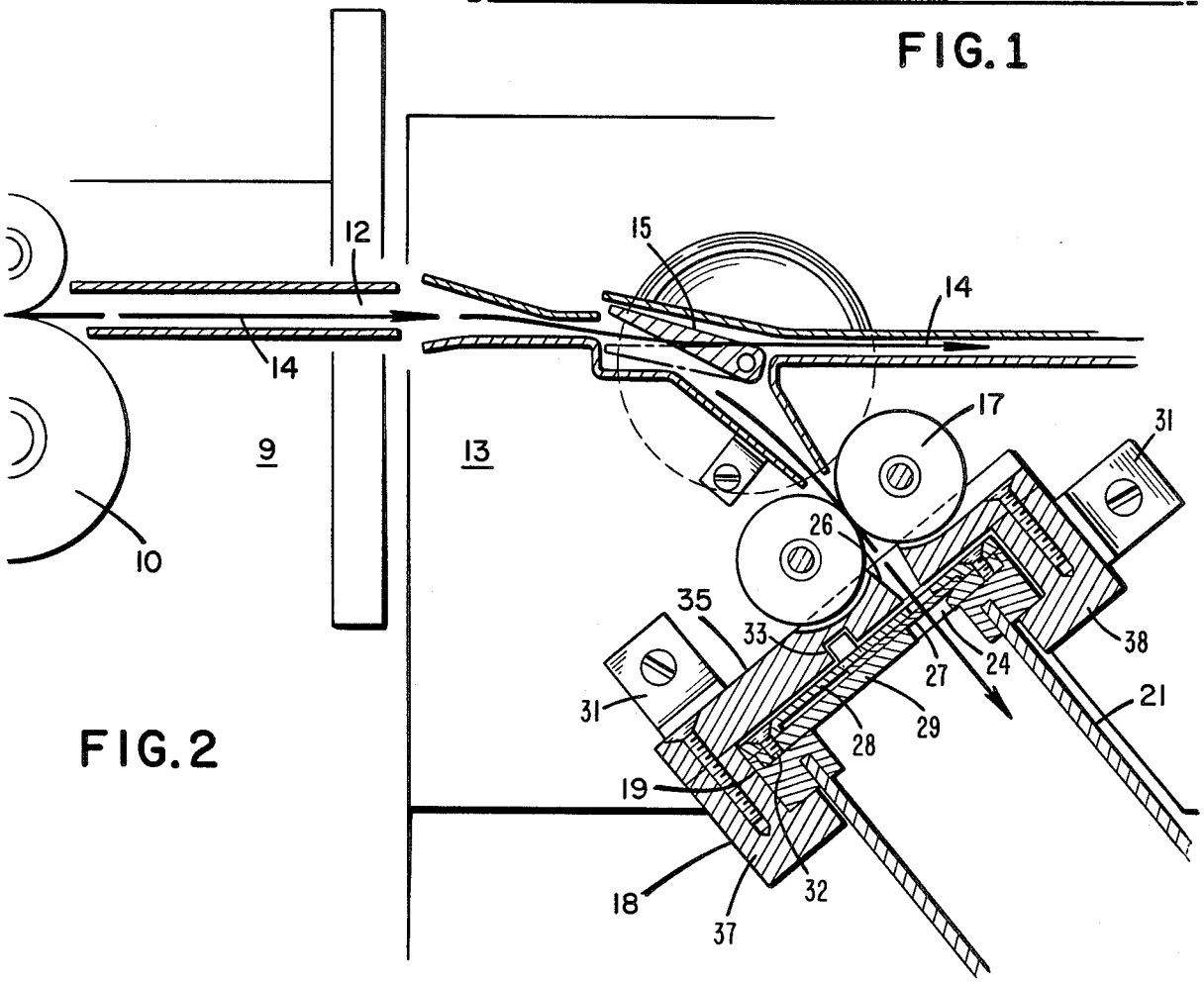
FIG. 2 illustrates the operation of the phototypessetter and film processor of FIG. 1 when exposed film or paper sheets are fed to the cassette storage device.

Cassette device 21 is removed by sliding the cassette device 21 laterally outward. Flange 19, at the top of the cassette, will slide freely in the channel 18 which supports the cassette in the conveyor feeding processor 13. A support 25 will assist in maintaining the cassette 21 at an angle to the processor. The cassette is maintained at an angle to the processor 13 to facilitate the free flow of cut film sheets into the cassette device 21. Referring to FIG. 2, a detail of the cassette 21 is shown with respect to the entrance slot. Cut-sheet material conveyed along path 14 past diverter 15 is directed by rollers 17 into a slot 26. Slot 26 is a longitudinal slot in the support channel 35. A similar slot 24 is located in the flange 19.

Flange 19 includes a movable door 27 which is operated by a pair of camming tabs. The door 27 is opened to permit a slot 26 in flange 19 to receive exposed photographic material.

Figures 3, 4, 5, 6:
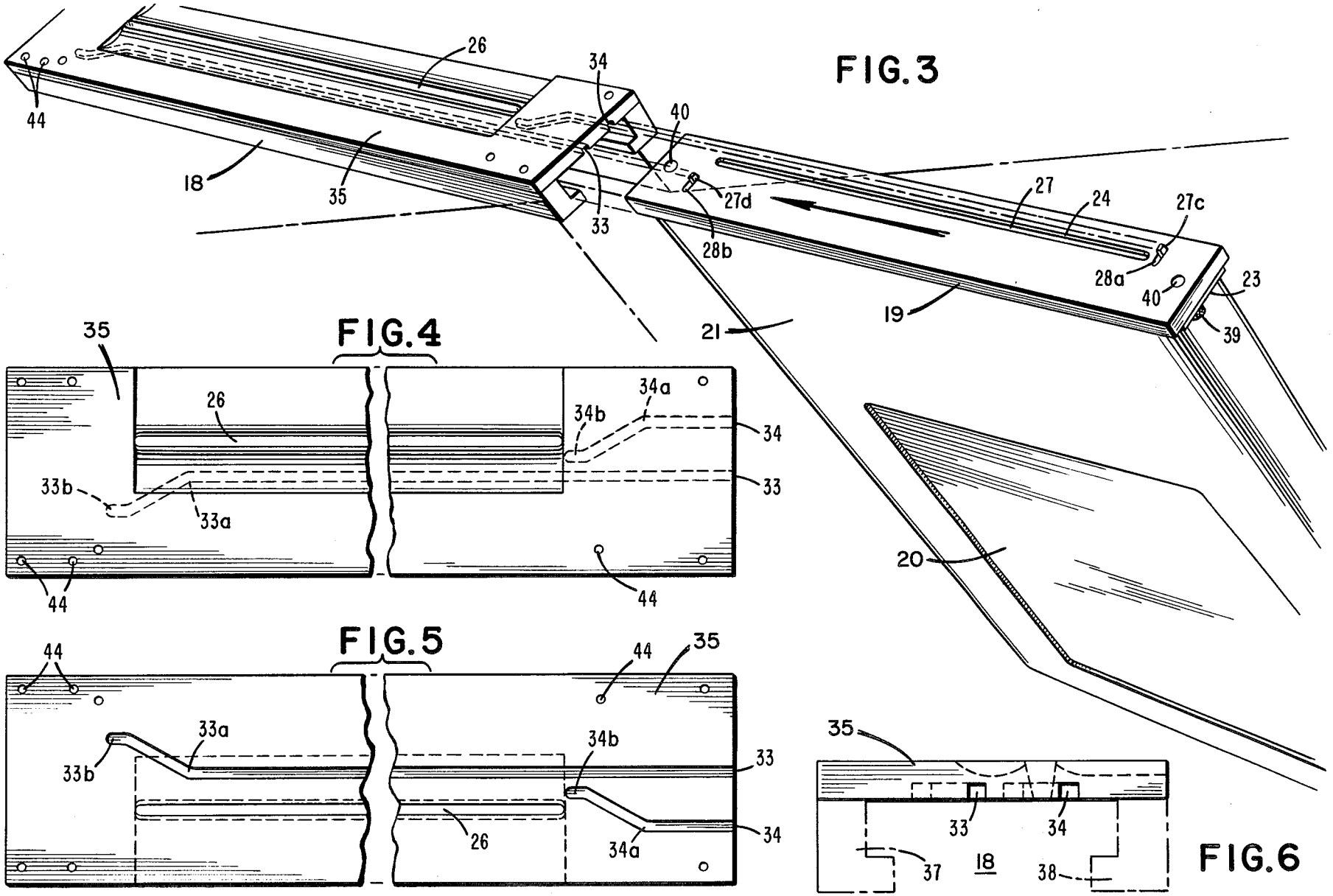
FIG. 3 illustrates in detail the relationship between the supporting channel and the cassette storage device flange.
FIG. 4 is a top view of the supporting channel 18.
FIG. 5 is a bottom view of the supporting channel 18.
FIG. 6 is a side view of the supporting channel 18.

The operation of the door 27 which opens and closes to seal the cassette 21 from light, avoiding inadvertent exposure of the photographic material, can be seen in FIG. 3. FIG. 3 illustrates the cassette 21 which includes a flange 19, shown to be held by two fasteners 39 and a threaded hole 40 to a flange 23. With the fasteners 39 on opposite sides of the cassette 21, the flange 19 can be separated from flange 23 integral with the rectangular enclosure forming cassette 21 in a darkroom to remove the contents of the cassette 21. Alternatively, a door 20 may be provided at the side of the cassette 21 to facilitate removal of its contents.

Shown also in FIG. 3 is the channel bracket 18 which is fastened to the film processor by a pair of brackets 31 of FIG. 2. The channel bracket 18 includes two supporting legs 37 and 38 as shown in FIG. 6 and a base 35. A pair of camming channels 33 and 34 are included on the base 35 of the channel bracket 18. The base 35 includes a slot 26 which is in alignment with the slot 24 of the flange 19, when the cassette 21 is fully inserted in the channel bracket 18.

Upon insertion of the flange 19 into channel bracket 18, camming tabs **27*c* and 27*d* will be moved such as to open the door 27 uncovering the slot 24 of the flange 19**.

FIGS. 4, 5 and 6 show details of the base 35, top, bottom and end views, to illustrate the configuration of the camming channels 33 and 34. A first camming channel 33 extends parallel to and on one side of slot 26, to a point **33*a*. The camming slot 33 then breaks and extends away from the slot 26, ending at a point 33*b*. Holes 44 are provided in base 35 to permit fastening to legs 37 and 38** which have matching threaded holes for receiving suitable fasteners.

Camming channel 34 begins at a point parallel to the slot 26 but on the other side of slot 26, and extends to a point **34*a* before changing direction and extending toward the longitudinal axis of slot 26. A final termination of camming channel 34 is shown at 34*b* on the same side of slot 26 as camming channel 33**.

With the camming channels 33 and 34 as shown in FIG. 4, flange 19 of the cassette device 21 may be inserted in channel bracket 18, and when each of the corresponding camming tabs **27*c* and 27*d* reach points 33*a* and 34*a* in their respective camming channels, the door 27 will be moved to the open position, permitting a through passageway through slot 24 into the cassette 21**.

FIGS. 7 through 12 illustrate in greater detail the structure of the flange 19 and associated slidable door 27 of the preferred embodiment. The flange 19 comprises a top plate 28 and a bottom plate 29 shown held together by screws 32 of FIG. 2. Top plate 28 includes a recess 30 for receiving the door 27. Two lateral slots, **28*a* and 28*b*, in top plate 28 receive the camming tabs 27*c* and 27*d* of the slidable door 27. Thus, door 27 is captured between plates 28 and 29 and is free to move in a lateral direction inside the recess 30 to cover and uncover a sheet feeding slot 24 in each of the plates 28 and 29. Two additional lateral slots, 29*a* and 29*b*, appear in the top plate 28 and bottom plate 29. These slots will each receive one end of the springs 36 or 35, maintaining the springs laterally fixed. Two corresponding slots 27*a* and 27*b* in slidable door 27 will retain the remaining end of springs 35 and 36. FIG. 12 illustrates the change in position of the camming tabs 27*c* and 27*d*. As the cassette 21 is slid into the channel bracket 18, the tabs 27*c* and 27*d* are moved from the closed position against springs 35 and 36, forcing door 27 away from the end 30*c* of recess 30. Upon opening, the door 27 is forced against the spring 36, and held there by the tabs 27*c* and 27*d* in camming channels 33 and 34. Thus, the paper or film sheets are free to feed through darkened common channel 24 now open to receive the paper or film sheets. After the material sheets have accumulate in the cassette 21, the cassette is removed by sliding the flange 19 out of channel 18. The camming tabs 27*c* and 27*d* will ride in the camming channels 33 and 34. The springs 35 and 36 urge door 27 into the closed position against end 30*c* of slot 30. Thus, the cassette is sealed against light, avoiding any further exposure of the sheets in cassette 21**. Thus, there is described with respect to the several Figures a preferred embodiment of the present invention. Those skilled in the art will clearly recognize other embodiments described more particularly by the claims which follow.

What is claimed is:

1. In a system for transferring film material sheets to a processing system, and alternatively diverting said sheets to a storage cassette, a removable light-tight cassette for storing said film material sheets comprising:

a mounting bracket for supporting a rectangular enclosure in a position for receiving said sheets, said bracket including a rectangular channel having a base with a first longitudinal extending slot for passing said material sheets, and first and second lateral camming slots, the first of said camming slots beginning on one side of said longitudinal slot, extending parallel to said longitudinal slot and thence at an angle away from said longitudinal slot, said second camming slot beginning at an opposite side of said longitudinal slot extending parallel to said longitudinal slot and thence at an angle thereto, ending at a point between said longitudinal slot and said first camming slot; and, a cassette for storing said film material sheets comprising a rectangular flange having a width and thickness for being received in said rectangular channel, said flange having a slot which aligns with said material passing slot;

a spring biased door supported for movement in the plane of said flange to cover said slot, said door being movable between a covering position and an uncovering position, said door including on opposite ends two upstanding camming tabs, each located on an opposite side of said material passing slot and positioned to be received in one of said camming slots; and an enclosure connected to said flange for receiving and storing said material sheets.

2. The apparatus of claim 1 wherein said flange comprises a top and bottom plate having a recess therebetween for receiving said door, said door having at opposite ends thereof first and second slots for receiving first and second springs for biasing said door towards a through slot in both said plates; and said top plate including first and second lateral slots which receive said first and second upstanding camming tabs.

3. The apparatus of claim 1 wherein said mounting bracket is positioned to support said cassette at an angle with respect to vertical.

4. The apparatus of claim 1 wherein said rectangular flange and said enclosure are connected together by a second flange on said enclosure which includes at least two threaded fasteners which are received in threaded holes of said rectangular flange.

* * * * *